United States Patent [19]

Murakami

[11] Patent Number: 4,756,223

[45] Date of Patent: Jul. 12, 1988

[54] AUTOMATIC PLAYER PIANO

[75] Inventor: Kazuo Murakami, Shizuoka, Japan

[73] Assignee: Yamaha Corporation, Hamamatsu, Japan

[21] Appl. No.: 64,055

[22] Filed: Jun. 19, 1987

[30] Foreign Application Priority Data

Jun. 20, 1986 [JP] Japan ..... 61-144172

[51] Int. Cl.[4] ..... G10F 1/02; G10C 3/26

[52] U.S. Cl. ..... 84/21; 84/226

[58] Field of Search ..... 84/35–38, 84/18–23, 107, 111–115, 216–223, 226, 244–246

[56] References Cited

U.S. PATENT DOCUMENTS

| | | | |
|---|---|---|---|
| 945,850 | 1/1910 | Mayer | 84/226 |
| 1,184,244 | 5/1916 | Kelly | 84/20 |
| 1,284,146 | 11/1918 | Russell | 84/35 |
| 1,313,141 | 8/1919 | Votey | 84/35 |
| 1,414,680 | 5/1922 | Wessell | 84/35 |
| 1,428,501 | 9/1922 | Gustafson | 84/35 |
| 1,831,733 | 11/1931 | Arostegui | 84/226 |
| 4,169,401 | 10/1979 | Walker | 84/22 |

*Primary Examiner*—W. B. Perkey

*Attorney, Agent, or Firm*—Burns, Doane, Swecker & Mathis

[57] ABSTRACT

An automatic player piano in which solenoid-operated key actuator units are provided respectively in association with the individual keyboard keys and are energized normally with signals effective to produce sounds with dynamic levels within a predetermined, selectable operable range of the player piano, wherein when it is desired that the player piano be used as a background music player, the key actuator units are energized with signals effective to produce sounds with dynamic levels within another range at least partially lower than the predetermined operable range of the player piano.

6 Claims, 6 Drawing Sheets

AUTOMATIC PLAYER PIANO

FIELD OF THE INVENTION

The present invention relates to an automatic player piano and, more particularly, to an automatic player piano at least having an automatic playback mode of operation in which a recorded piece of music information is to be played back at a selected sound level.

BACKGROUND OF THE INVENTION

It is sometimes desired that an automatic player piano having such a playback mode of operation be used as a background music player. When used for such a purpose, it is further desired that the player piano play back a music with utmost softness preferably through generation of sounds with a dynamic range even lower than the lowest dynamic range established for the piano. If a hammer head of the action mechanism of the player piano is driven with a force less than the force corresponding to such a minimum dynamic level, the hammer head could not effectively strike against the string and accordingly would fail to generate sound at the string. it may also be pointed out that a force reduced excessively could not drive the hammer head for movement at a proper velocity toward the string and would thus could not strike against the string at a proper timing, destroying the tempo at which the music is to be played back. It is a prime object of the present invention to provide an automatic player piano free from these problems encountered when the piano is to operate in playback mode at a lowered sound level.

SUMMARY OF THE INVENTION

In accordance with another outstanding aspect of the present invention, there is provided an automatic player piano including a plurality of keyboard keys and having a first mode of playback operation producing sounds with sound intensity levels within a predetermined operable range inherent in the player piano and a second mode of playback operation producing sounds with sound intensity levels within a predetermined lower range at least partially lower than the predetermined operable range, comprising:

(a) selector means for selecting one of the first and second modes of operation, (b) sound level reducing means for reducing the sound intensity levels of the sounds to be produced by the player piano and being actuated in response to selection of the second mode of operation, (c) data means producing intensity information representative of a plurality of different sound intensity ranges each defining a predetermined number of different sound intensity levels, and (d) key driver means operative to actuate selected ones of the keyboard keys on the basis of the information representative of the different sound intensity ranges produced by the data means except for the lowest one of the different sound intensity ranges when the first mode of operation is selected by the selector means and on the basis of the information representative of the lowest one of the different sound intensity ranges when the second mode of operation is selected by the selector means.

In accordance with another outstanding aspect of the present invention, there is provided an automatic player piano comprising:

(a) a plurality of keyboard keys;

(b) a plurality of piano strings respectively associated with the keyboard keys;

(c) an action mechanism intervening in effect between the plurality of keyboard keys and the plurality of piano strings, the action mechanism including string striking members respectively associated with the keyboard keys and with the piano strings, each of the string striking members being responsive to the movement of the associated one of the keyboard keys and operative to strike against the associated one of the piano strings, and sound level reducing means for reducing the intensity levels of sounds to be produced by the string striking members, the sound level reducing means being moveable from an inoperative first position to an operative second position;

(d) a plurality of separate key actuating means respectively associated with the keyboard keys and each operative to actuating the associated one of the keyboard keys when activated;

(e) activating means for activating each of the key actuating means;

(f) memory means storing musical information representative of music which may be played back by the player piano, the musical information including pieces of sound intensity level information;

(g) data storage means for producing sound intensity information representative of a plurality of different sound intensity ranges each having a predetermined number of different sound intensity levels respectively corresponding to the pieces of sound intensity level information stored in the memory means, the activating means being responsive to the information supplied from the memory means and the data storage means for activating each of the key actuating means at each of the intensity levels represented by the sound intensity information;

(h) selector means for selecting one of the sound intensity ranges produced by the data storage means; and (i) drive means for moving the sound level reducing means from the first position to the second position when the lowest one of the plurality of sound intensity ranges is selected.

BRIEF DESCRIPTION OF THE DRAWINGS

The drawbacks of a prior-art automatic player piano and the features and advantages of an automatic player piano according to the present invention will be more clearly understood from the following description taken in conjunction with the accompanying drawings in which like reference numerals designate similar or corresponding structures, units, members and elements and in which.

DESCRIPTION OF THE PRIOR ART

Figure 1A:
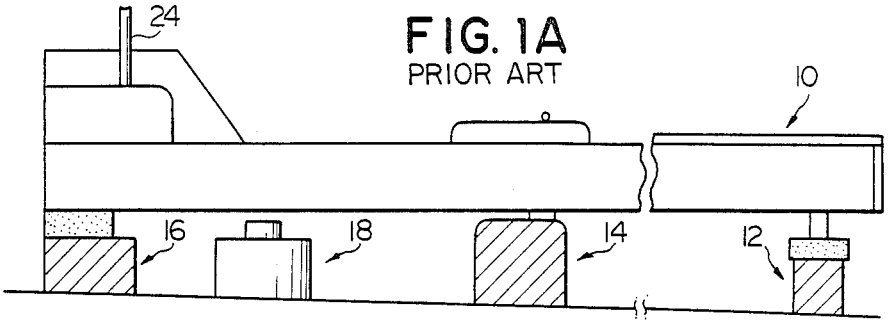
FIG. 1A PRIOR ART
FIG. 1A is a fragmentary side elevation view showing part of the keyboard arrangement of an ordinary automatic player piano.

In FIG. 1A is shown the action mechanism of an ordinary upright-type automatic player piano which has a keyboard including a number of keys which in FIG. 1 is represented by a single white whole-tone key 10. Illustrated in association with this key 10 are a front key guide assembly 12, a key balancer assembly 14 and a key rest assembly 16. The front key guide assembly 12 includes a front key rail member, a front punching, and a key guide pin. The key balancer assembly 14 includes a balance rail member, a balance punching, a key button, and a balance pin. The key rest assembly 16 includes a rear key rail member and a key cloth attached thereto. The arrangement of these component members and elements of the assemblies 12, 14 and 16 of the keyboard is not only well known in the art but is rather immaterial to the understanding of the gist of the present invention and, for these reasons, will not be herein described.

In FIG. 1A is further shown a solenoid-operated key actuator unit 18 which is to be activated in response to electric driver signals representative of the musical information to be played back by the player piano. The solenoid-operated key actuator unit 18 is one of such units respectively provided in association with all the keys 10 on the keyboard. When the solenoid-operated key actuator unit 18 is energized with a driver signal during automatic playback mode of operation of the player piano, the key actuator unit 18 drives the associated key 10 into a position to produce sound at the associated one of the piano strings which are represented by a single piano string 20 in FIG. 1B. The purpose and function of such a solenoid-operated key actuator unit 18 will become clearer as the description proceeds.

Figure 1B:
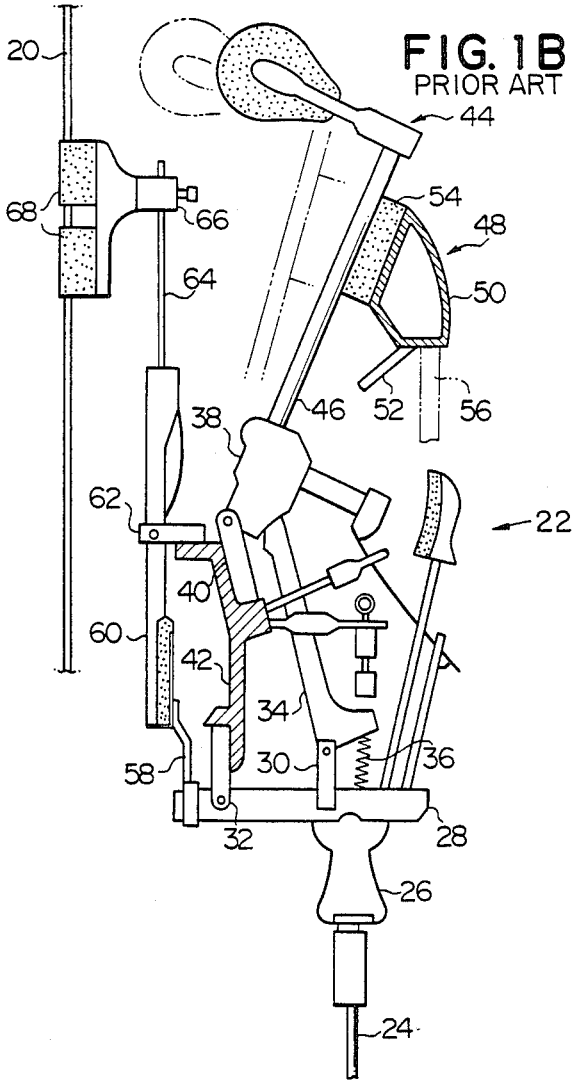
FIG. 1B PRIOR ART
FIG. 1B is a fragmentary side elevation view showing part of the action mechanism of the ordinary automatic player piano.

The individual keys 10 on the keyboard are respectively associated with the piano strings 20 through a piano action mechanism which consists of a number of action units each intervening, in effect, between one of the keys 10 and the associated one of the piano strings 20. Each of these piano action units, herein represented by a piano action unit 22 as shown in FIG. 1B, comprises a vertically extending capstan wire 24 anchored at its lower end to a rear end portion of the key 10 as will be gathered from FIGS. 1A and 1B. The capstan wire 24 is tied at its upper end to a capstan button 26 which is held in engagement with a wippen 28. The wippen 28 in turn has fixedly attached thereto two flange members 30 and 32 each extending upwardly from the wippen 28. One flange member 30 is fixedly connected to the wippen 28 and has a jack 34 supported thereon. The jack 34 is in the form of a bell-crank lever having an intermediate fulcrum portion pivotally connected to the flange member 30. The jack 34 has one arm portion extending upwardly from the fulcrum portion and another arm portion to which a jack spring 36 anchored at one end of the wippen 28 is anchored at the other end as shown. The jack spring 36 thus urges the jack 34 as a whole to turn with respect to the wippen 28 in a direction in which the upwardly extending arm portion of the jack 34 rocks forwardly of the piano frame (not shown).

The upwardly extending arm portion of the jack 34 has at its upper end a slanting slide surface held in slidable contact with a correspondingly contoured surface portion of a hammer bat 38. The hammer bat 38 in turn is pivotally connected by means of a center pin to a hammer bat support flange member 40 secured to a stationary main action rail member 42. The main action rail member 42 is horizontally elongated laterally of the piano frame and is fixedly coupled to and supported by the action support bracket structure (not shown) bolted or otherwise secured to the piano frame. To a lower end portion of this main action rail member 42 is fixedly attached the other, 32, of the two flange members 30 and 32 on the wippen 28.

The hammer bat 38 forms part of a string striking hammer assembly which further includes a hammer head 44 connected to the hammer bat 38 by means of a hammer shank 46, the hammer head 44 being usually wrapped in a pad of felt as shown. The hammer shank 46 is secured at its lower end to the hammer bat 38 and at its upper end to the hammer head 44 which is directed toward the particular piano string 20 with which the piano action unit 22 under consideration is associated.

In association with the string striking hammer assembly thus constructed and arranged generally is provided a hammer rest rail assembly 48 including a hammer rest rail member 50. The hammer rest rail member 50 is pivotally connected to the action support bracket structure by suitable pivot means such as typically a hammer rest rail member hinge member 52 only a portion of which is herein shown. The hammer rest rail member 50 is thus pivotally movable with respect to the action support bracket structure and accordingly to the piano string 20 about a horizontal axis fixed with respect to the bracket structure. Such a hammer rest rail member 50 extends horizontally of the piano frame at least throughout the length of the keyboard, though not seen in the drawings. Ordinarily, the hammer rest rail assembly 48 further comprises a pad of felt 54 bonded or otherwise secured to the flat rear face of the hammer rest rail member 50 as shown. Though not shown in the drawings, the hammer rest rail member 50 further has a flat bottom surface portion with which is engageable the flat upper surface of a forwardly extending arm or ledge portion of the action support bracket structure, as well known in the art.

As will be thus seen from the foregoing description and also as well known in the art, the spring striking hammer assembly 44 as a whole is pivotally movable into striking contact with the associated piano string 20 about an axis fixed with respect to the piano frame when the keyboard key 10 with which the piano action unit 22 is associated is manually depressed or automatically actuated. The key 10 may be either automatically actuated by means of the solenoid-operated key actuator unit 18 or manually depressed by the operator playing the piano. The hammer rest rail assembly 48 is normally received on the upper surface of the arm or ledge portion of the action support bracket structure due to its own weight. The hammer shank 40 which forms part of the hammer assembly is in turn received on the felt pad 54 of the hammer rest rail assembly 48 as indicated by full lines in FIG. 1B. Accordingly, the sound to be produced by the string 20 struck by the hammer head 44 will have an intensity which is dictated by the distance between the hammer rest rail assembly 48 and piano string 20 or, in other words, the angular stroke through which the hammer rest rail assembly 48 is allowed to turn about the center pin on the hammer bat 38 until the hammer head 44 strikes against the string 20.

The intensity of the sound to be produced by the string 20 can thus be varied or lessened by reducing the distance between the hammer rest rail assembly 48 and string 20 or the angular stroke of the hammer rest rail assembly 48 about the center pin on the hammer bat 38. A soft pedal (not shown) is therefore provided for the purpose of softening the sounds to be produced by the piano strings 20 when desired by the operator playing the piano. The soft pedal is associated with the hammer rest rail assembly 48 through a pedal action mechanism which includes a soft pedal plunger rod 56 extending upwardly from the vicinity of the rear end of the soft pedal. The soft pedal plunger rod 56 is at its upper end coupled to or held in abutting engagement with the flat bottom surface portion of the hammer rest rail member 50 as shown. As well known in the art, the plunger rod 56 is caused to endwise move upwardly to cause the hammer rest rail assembly 48 to turn rearwardly through a predetermined angle about the center pin on the hammer bat 38 when the soft pedal is depressed by the operator playing the piano. The hammer rest rail assembly 48 being thus turned, the hammer head 44 of the hammer assembly having the shank 40 received on the felt pad 54 of the hammer rest rail assembly 48 is allowed to have a position closer to the piano string 20 as indicated by phantom lines in FIG. 1B and accordingly to produce a softer sound when driven into striking engagement with the string 20.

In combination with such a soft pedal action is provided a damper or loud pedal action which operatively intervenes between a damper or loud pedal (not shown) and the piano string 20. The damper or loud pedal action is shown including a damper spoon 58 upstanding from the wippen 28 and a damper lever 60 pivotally connected to a lever support flange member 62 secured to the main action rail member 42 and having a lower end portion engaged by the damper spoon 58. A damper wire 64 extends upwardly from the damper lever 60 and has an upper end portion anchored by means of a screw to a damper block 66 having a damper head members 68 of felt pad attached to its rear face. The damper head 68 is normally held in contact with the piano string 20 and is disengaged from the string 20 when the damper or loud pedal is depressed by the operator playing the piano.

Figure 2:
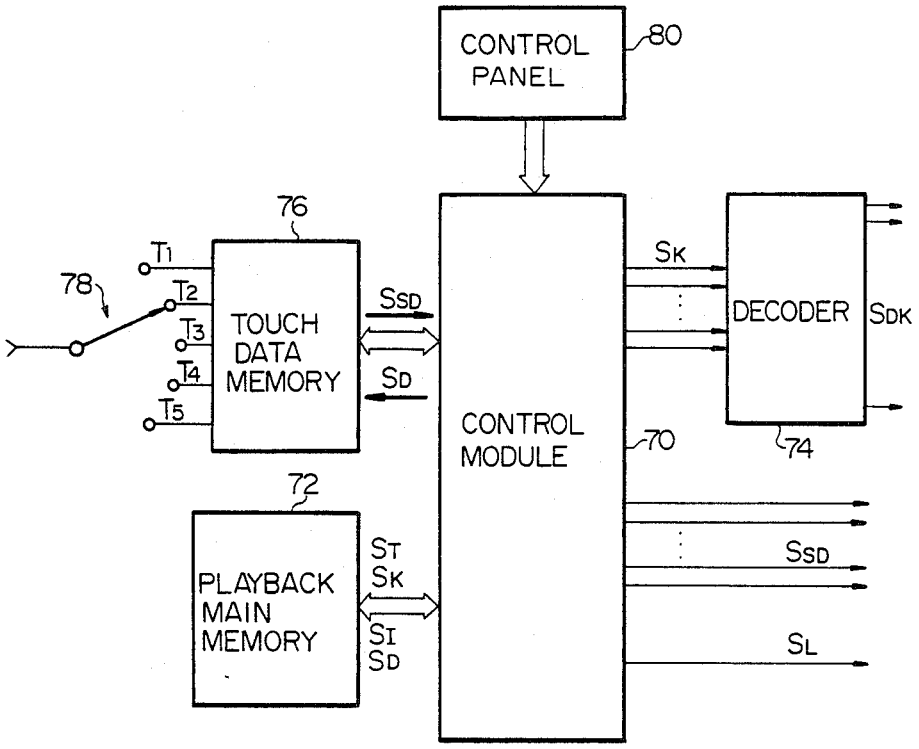
FIG. 2 PRIOR ART
FIG. 2 is a block diagram showing a typical example of the playback control circuit provided in a prior-art automatic player piano.

In the player piano having the action mechanism constructed and arranged as hereinbefore described, each of the solenoid-operated key actuator units represented by the solenoid-operated key actuator unit 18 is to be activated by drive signals produced under the control of a playback control circuit comprising a control module 70 in the arrangement shown in FIG. 2. The playback control module 70 receives data signals from a main memory 72 in which is stored coded information necessary for the reproduction of the music to be automatically played back by the player piano. The coded musical information stored by this main data memory 72 includes not only the pieces of information $S_T$ representative of the keys, in terms of key-on and key-off signals, of the music to be reproduced but also information $S_K$ representative of the key code assigned to the respective keys used by the music to be played back. The musical information stored by the main data memory 72 further includes information $S_D$ representative of the time durations for which the keys 10 to produce the sounds are to remain actuated by the solenoid-operated key actuator units 18 and dynamic level information $S_I$ representative of the intensities, or dynamic levels, with which sounds are to be produced by the piano strings 20 by energization of the solenoid-operated key actuator units 18. In the embodiment herein shown, such dynamic level information $S_I$ is assumed to have a word length of seven bits by way of example and is accordingly capable of expressing a total of 128 different intensities of sound or dynamic levels.

The playback control module 70 has incorporated therein a microprocessor unit which reads from the various pieces of information thus stored in the data memory 72. The microprocessor in the control module 70 then passes the key code information $S_K$ to a decoder network 74 and the dynamic level information $S_I$ to a touch memory 76 having various touch data or dynamic levels memorized in the form of table data. From the decoder network 74 are thus output a decoded key code signal $S_{DK}$ representative of the key code information $S_K$ read from the main data memory 72. In the embodiment herein shown, the touch data memory 76 has a total of five table sections which are respectively assigned to five different dynamic ranges consisting of first to fifth dynamic ranges. The first to fifth dynamic ranges are higher in this sequence so that the first dynamic range contains sound intensity levels of the highest dynamic range and the fifth dynamic range contains sound intensity levels of the lowest dynamic range with the broadest dynamic range provided by the intermediate third dynamic range. The dynamic level information read from the main data memory 72 being in the form of seven-bit words, each of the five table sections of the touch data memory 76 has memorized therein a total of 128 different dynamic levels respectively corresponding to the 128 dynamic levels readable from the main data memory 72. These five table sections of the touch data memory 76 are open to selection by means of a dynamic range selector switch 78. The dynamic range selector switch 78 has five, first to fifth states $T_1$ to $T_5$ effective to select the five table sections, respectively, of the touch data memory 76.

The playback control module 70 is further associated with a control panel 80 which includes various manually operated switches and controls, though not shown. These switches and controls may typically include a power supply switch to be used when automatic playback mode of operation is to be selected, a playback start switch to be used to start a automatic playback operation and a playback stop switch to be used to bring an end to the automatic playback operation once started.

Figure 3:
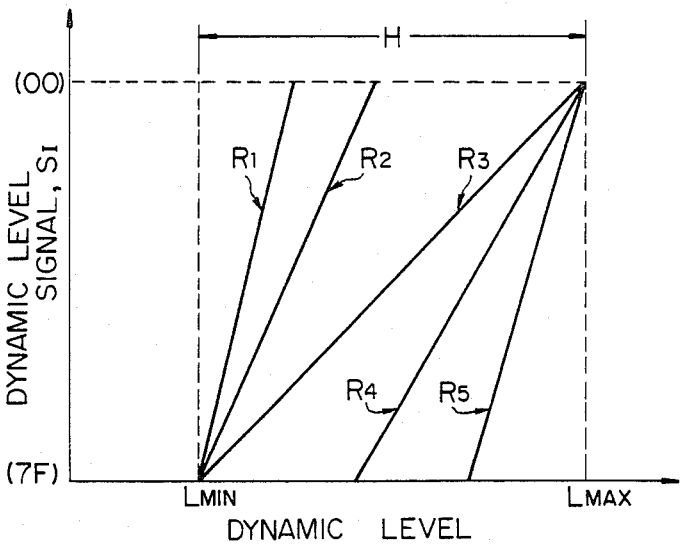
FIG. 3 PRIOR ART
FIG. 3 is a graphic representation of the different dynamic ranges used in the playback control circuit illustrated in FIG. 2.

The table data for the five dynamic ranges as stored within the touch data memory 78 may be formulated in a manner to implement the schedules illustrated in FIG. 3. In FIG. 3, the first to fifth dynamic ranges fall within a dynamic range H operable with the piano and are represented by plots $R_1$ to $R_5$, respectively. Each of these plots $R_1$ to $R_5$ represents the respective dynamic levels for the 128 possible variations of the dynamic level information $S_I$ from the main data memory 72. The 128 variations of the supplied dynamic level information $S_I$ are shown ranging from the least significant bit 00 to the most significant bit 7F expressed in hexadecimal notation, while the operable dynamic range H operable with the piano is shown to span from a predetermined minimum dynamic level $L_{MIN}$ to a predetermined maximum dynamic level $L_{MAX}$. As will be seen from this FIG. 3, the lower two dynamic ranges, viz., the first and second dynamic ranges respectively represented by the plots $R_1$ and $R_2$ have their lower limits commonly set at the minimum dynamic level $L_{MIN}$ of the operable dynamic range H and respective upper limits higher for the second dynamic range than for the first dynamic range in this sequence. On the other hand, the upper two dynamic ranges, viz., the fourth and fifth dynamic ranges respectively represented by the $R_4$ and $R_5$ have their upper limits commonly set at the maximum dynamic level $L_{MAX}$ of the operable dynamic range H and respectively lower limits higher for the fifth dynamic range than for the fourth dynamic range. Furthermore, the third dynamic range represented by the plot $R_3$ has its lower and upper limits respectively set at the minimum and maximum dynamic levels $L_{MIN}$ and $L_{MAX}$ of the operable dynamic range H and thus fully covers the operable dynamic range H. The minimum dynamic level $L_{MIN}$ of the operable dynamic range H is dictated by, or corresponds to, the smallest possible force with which the hammer heads 44 of the action mechanism shown in FIG. 1 is enabled to effectively strike against the associated piano string 20 when driven from the solenoid-operated key actuator unit 18. If the hammer head 44 is driven from the solenoid-operated key actuator unit 18 with a force less than the force thus corresponding to the minimum dynamic level $L_{MIN}$, the hammer head 44 could not effectively strike against the string 20 and would fail to generate sound at the string 20. On the other hand, the maximum dynamic level $L_{MAX}$ of the operable dynamic range H is determined to provide a reasonable force with which the hammer head 44 is to be driven to generate sound with a desired maximum intensity. The dynamic levels within each of the five dynamic ranges are stored in each of the five table sections of the touch data memory 78 so that one of the dynamic ranges is selected when the corresponding one of the first to fifth states $T_1$ to $T_5$ of the dynamic range selector switch 78 is activated.

In response to each of the signals representative of the dynamic level information $S_I$ received from the main data memory 72 by way of the microprocessor unit of the control module 70, the touch data memory 76 picks up the corresponding dynamic level out of the 128 different dynamic levels in the dynamic range memorized in the table section selected by the dynamic range selector switch 78 and outputs a digital dynamic level or solenoid drive control signal $S_{SD}$ representative of the dynamic level thus picked up. Solenoid drive signals $S_{SD}$ are thus successively fetched from the touch data memory 76 and are output from the control module 70 for the successive signals representative of the tone information $S_T$ also read from the main data memory 72. Each of the solenoid drive control signals $S_{SD}$ thus output from the touch data memory 76 consists of a bit string having a "1" or "0" most significant bit in accordance with which the solenoid-operated key actuator unit 18 designated by each of the signals representative of the tone information $S_T$ is to be energized or to remain de-energized, respectively. From the control module 70 is further supplied a load instruction signal $S_L$ to be predominant over the timing at which the solenoid-operated key actuator units 18 are to be activated in the presence of a signal representative of the tone information $S_T$. These solenoid drive control signals $S_{SD}$ and load instruction signals $S_L$ as well as the decoded key code signal $S_{DK}$ output from the decoder network 74 are passed over to a solenoid drive control circuit for driving selected ones of the solenoid-operated key actuator units 18 shown in FIG. 4.

Figure 4:
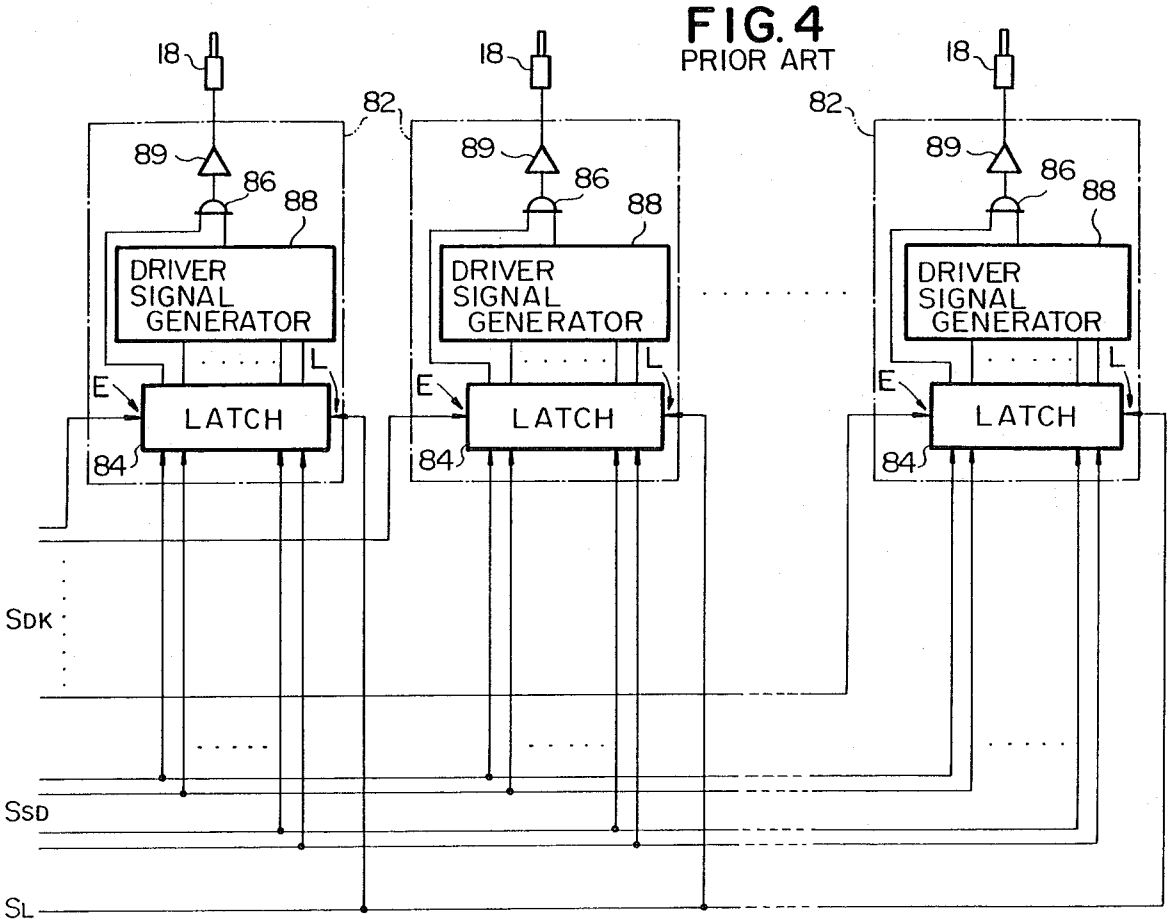
FIG. 4 PRIOR ART
FIG. 4 is a block diagram showing a typical example of the solenoid drive control circuit provided in a prior-art automatic player piano.

Referring to FIG. 4, the solenoids drive control circuit comprises a parallel combination of a number of solenoid driver sections 82 which are provided respectively in association with the individual solenoid-operated key actuator units 18 in the keyboard of the piano. Each of these solenoid driver sections 82 comprises a latch circuit 84 having parallel data input terminals responsive to the individual bits of each of the solenoid drive control signals $S_{SD}$ from the control module 70. The latch circuit 84 of each solenoid driver section 82 further has an enable terminal E connected to one of the parallel output terminals of the decoder network 74 and receives at this enable terminal E the decoded key code signal $S_{DK}$ from the decoder network 74 shown in FIG. 2. The latch circuit 84 further has a load control terminal L responsive to the load instruction signal $S_L$ from the control module 70. Thus, the latch circuit 84 supplied with a solenoid drive control signal $S_{SD}$ from the control module 70 is enabled to latch the signal $S_{SD}$ therein in response to the key code signal $S_{DK}$ supplied from the decoder network 74 to the enable terminal E. In response to the load instruction signal $S_L$ thereafter supplied to the load control terminal L from the control module 70, the latch circuit 84 is unlatched so that the solenoid drive control signal $S_{SD}$ which has been latched in the latch circuit 84 is released therefrom. With the latch circuit 84 thus unlatched, the "1" or "0" most significant bit of the solenoid drive control signal $S_{SD}$ is passed to one of the two input terminal of a two-input AND gate 86 and the remaining bits of the signal $S_{SD}$ are fed in parallel to a solenoid driver signal generator circuit 88. The solenoid driver signal generator circuit 88 which is thus provided subsequently to the latch circuit 84 is operative to generate a solenoid driver signal with a pulse width dictated by the sequence of bits received from the latch circuit 86 and to supply the solenoid driver signal to the other input terminal of the AND gate 86. In the presence of a solenoid drive control signal $S_{SD}$ with a "1" most significant bit, the solenoid driver signal thus produced by the signal generator circuit 88 is passed through an amplified 89 to the associated solenoid-operated key actuator unit 18. The solenoid-operated key actuator unit 18 associated with the solenoid driver section 82 responsive to the key code signal $S_{DK}$ at the enable terminal E of the latch circuit 84 is thus energized with a current variable with the supplied solenoid drive control signal $S_{SD}$.

In the meantime, it has been desired to use an automatic player piano as a background music player. When used for such a purpose, the automatic player piano is required to automatically play back a music with utmost softness preferably through generation of sounds with a dynamic range even lower than the lowest dynamic represented by the plot $R_1$ shown in FIG. 3. Such a lower dynamic range may be represented by plot $R_0$ shown in FIG. 5 and, in this instance, has a lower limit lower than the minimum dynamic level $L_{MIN}$ of the operable dynamic range H and an upper limit intervening between the minimum dynamic level $L_{MIN}$ of the range H and the upper limit of the first dynamic range represented by the plot $R_1$ shown in FIG. 3.

If the hammer head 44 of the action mechanism shown in FIG. 1 is driven from the solenoid-operated key actuator unit 18 with a force less than the force corresponding to the minimum dyanmic level $L_{MIN}$ of the operable dynamic range H, the hammer head 44 could not effectively strike against the string 20 and accordingly would fail to generate sound at the string 20 as previously noted. This will occur when the dynamic levels represented by the dynamic level information $S_I$ read from the main data memory 72 are within a range $S_i$ in FIG. 5. It may also be noted that a force reduced excessively could not drive the hammer head 44 for movement at a proper velocity toward the string 20 and would thus destroy the tempo at which the music is to be played back. The present invention contemplates provision of an automatic player piano which is free from these problems encountered when the piano is to be used as a background music player.

DESCRIPTION OF THE PREFERRED EMBODIMENTS

Figure 6:
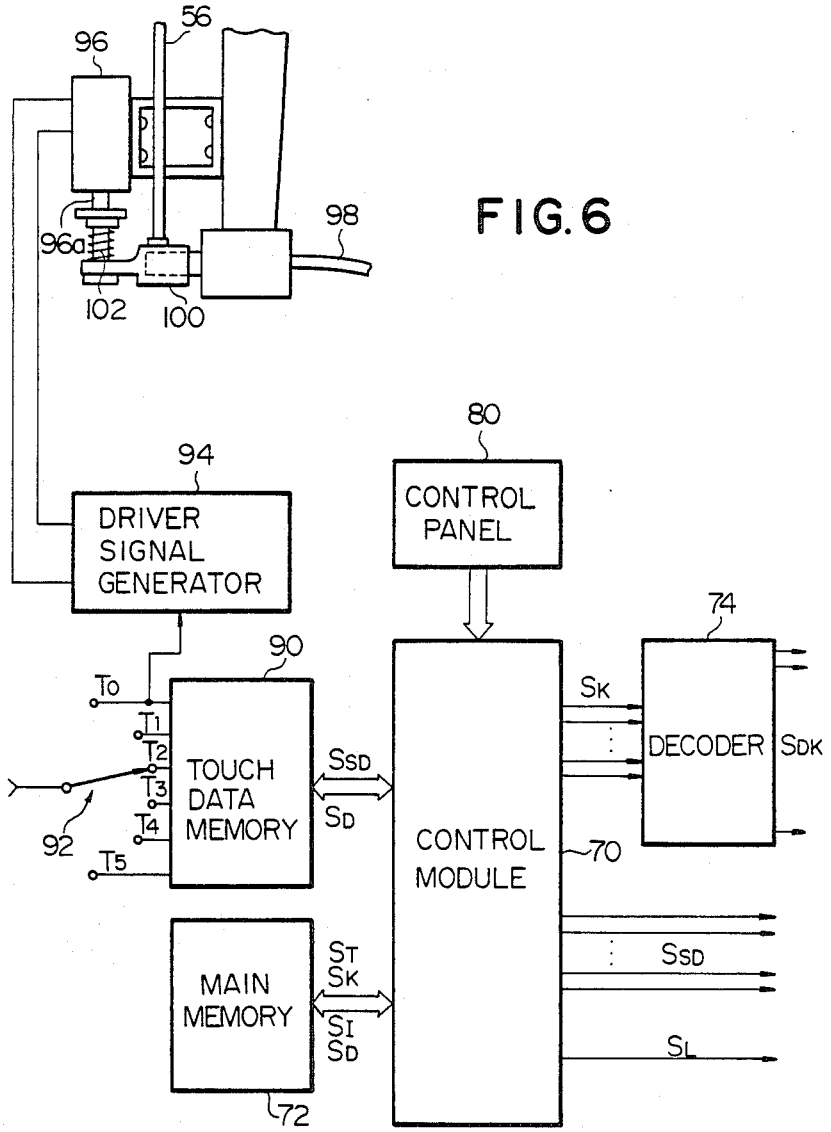
FIG. 6 is a block diagram showing the arrangement of the playback control circuit provided in a first preferred embodiment of an automatic player piano according to the present invention.

FIG. 6 shows part of a first preferred embodiment of an automatic player piano according to the present invention. The embodiment herein shown is generally similar in various respect to a prior-art automatic player piano typically having the design described with reference to FIGS. 1 to 4 and are thus assumed to have respective counterparts of all the component structures, units, members and elements of the described prior-art player piano.

In the automatic player piano embodying the present invention as shown in FIG. 6, the control circuit has a touch data memory, now denoted by reference numeral 90, which has a total of six table sections including a table section in addition to the five table sectios respectively similar to the first to fifth table sections forming the touch data memory 76 of the control circuit shown in FIG. 2. The additional dynamic range is represented by the plots $R_0$ shown in FIG. 5 and, accordingly, has a lower limit lower than the minimum dynamic level $L_{MIN}$ of the operable dynamic range H and an upper limit higher than the minimum dynamic level $L_{MIN}$ of the range H and lower than the upper limit of the first dynamic range represented by the plot $R_1$ shown in-FIG. 3. The touch data memory 90 having such an additional table section is associated with a dynamic range selector switch, now denoted by reference numeral 92, which has six states including an additional sixth state $T_0$ as well as the five states respectively similar to the first to fifth states $T_1$ to $T_5$ of the selector switch78 of the control circuit shown in FIG. 2. The sixth dynamic range $T_0$ of the selector switch 92 is effective to select the sixth table selection of the touch data memory 90. The dynamic range selector switch 90 is herein shown as if it were a mechanically driven five-position switch. This however is only one of the possibilities of the dynamic range selector switch means operable in an automatic player piano herein proposed. The dynamic range selector swith means of an automatic player piano according to the present invention may thus be implemented eitehr by any other form of hardware or through an appropriate software program.

The sixth state $T_0$ of the dynamic range selector switch 92 is associated with not only the sixth table section of the touch data memory 90 but a soft pedal drive signal generator circuit 94 electrically connected to a solenoid-operated soft-pedal actuator unit 96 of the self-hodling design. The soft pedal drive signal generator circuit 94 is operative to produce a driver signal for the solenoid-operated soft-pedal actuator unit 96 when the sixth state $T_0$ of the dynamic range selector switch 92 is activated. The solenoid-operated soft-pedal actuator unit 96 is provided in conjunction with the soft pedal, herein shown at 98, and has a plunger **96*a* connected at its leading end to a rear end portion of the soft pedal 98 by means of a connecting member 100 through which the hammer rest rail actuator rod 56 described with reference to FIG. 1 is coupled to the soft pedal 98. The plunger 96*a* of the solenoid-operated soft-pedal actuator unit 96 is urged to axially extend outwardly and allow the soft pedal 98 in the normal raised position thereof by means of a return spring 102 engaging the plunger 96*a* and connecting member 100 as shown. The control circuit thus arranged is connected to the solenoid-operated key actuator units 18 through a solenoid drive control circuit constructed and arranged similar to the circuit shown in FIG. 4**.

When, now, one of the first to fifth states $T_1$ to $T_5$ of the dynamic range selector switch 92 is activated, the corresponding one of the dynamic ranges memorized in the first to fifth table sections of the touch data memory 90 is selected. Under these conditions, the solenoid-operated key actuator units 18 are selectively energized to generate sounds with any one of the dynamic ranges represented by the plots $R_1$ to $R_5$ shown in FIG. 3, as described with reference to FIGS. 2 to 4.

On the other hand, when the sixth state $T_0$ of the dynamic range selector switch 92 is activated, the soft pedal drive signal generator circuit 94 produces a driver signal for the solenoid-operated soft-pedal actuator unit 96. The driver signal is supplied to and energizes the solenoid-operated soft-pedal actuator unit 96 so that the plunger **96*a* of the actuator unit 96 is forced to axially retract against the force of the spring 102 and causes the soft pedal 98 to move in a direction in which the soft pedal is to be moved when depressed. Such movement of the soft pedal 98 is followed by axially upward movement of the hammer reset rail actuator rod 56, which therefore causes the hammer rest rail assembly 48 (FIG. 1) to turn rearwardly through a predetermined angle about the center pin on the hammer bat 38. The hammer rest rail assembly 48 being thus turned, each of the hammer heads 44 of all the hammer assemblies having their respective shanks 40 received on the felt pad 54 ofthe hammer rest rail assembly 48 is allowed to have a position closer to the piano string 20 as indicated by phantom lines in FIG. 1B. The solenoid-operated soft-pedal actuator unit 96 may be designed so that the distance of movement of the hammer head 44 from the initial position to the position thus closer to the string 20 accounts for one third of the full angular stroke of the hammer head 44**.

Figure 5:
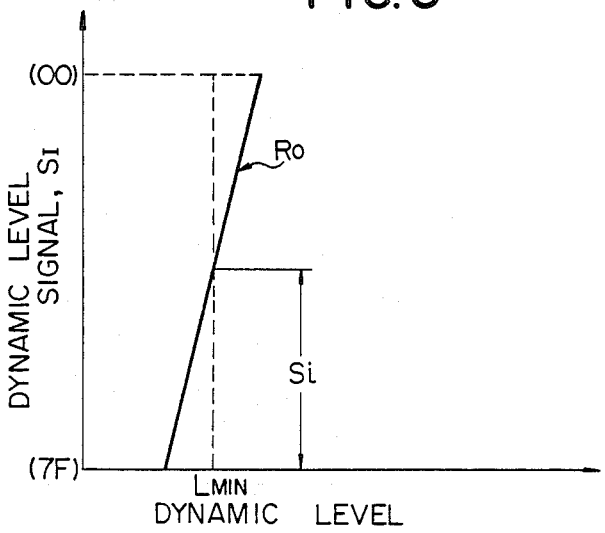
FIG. 5 is a graphic representation of the additional dynamic range which is desired to be used in the playback control circuit illustrated in FIG. 2.

The sixth state $T_0$ of the dynamic range selector switch 92 being activated, furtermore, the dynamic range memorized in the sixth table section of the touch data memory 90 is selected so that the solenoid-operated key actuator units 18 are selectively energized with currents controlled in such a manner as to provide the dynamic range represented by the plot $R_0$ shown in FIG. 5. Thus, the currents supplied to the solenoid-operated key actuator units 18 and accordingly the driving forces exerted by the solenoid-operated key actuator units 18 may happed to be smaller than values corresponding to the minimum dynamic level $L_{MIN}$ of the operable range H shown in FIGS. 3 and 5. Because, however, of the fact that all the hammer heads 44 of the action mechanism have been moved closer to the piano strings 20 as above discussed, the hammer heads 44 are enabled to effectively strike against the strings 20 even with such reduced forced exerted by the solenoid-operated key actuator units 18. In view, furthermore, of the fact that the hammer heads 44 are positioned closer to the strings 20, the hammer heads 44 are permitted to reach the strings 20 at proper timings and would not destroy the tempor at which the music is to be played back.

While it has been described that a solenoid-operated actuator unit is provided in conjunction with the soft pedal 98 to act on the hammer rest rail assembly 48 through the intermediary of the soft pedal 98, a similar actuator unit may be provided in conjunction with the hammer rest rail assembly 48 per se so as to be capable of directly acting on the rail assembly 48.

Figure 7:
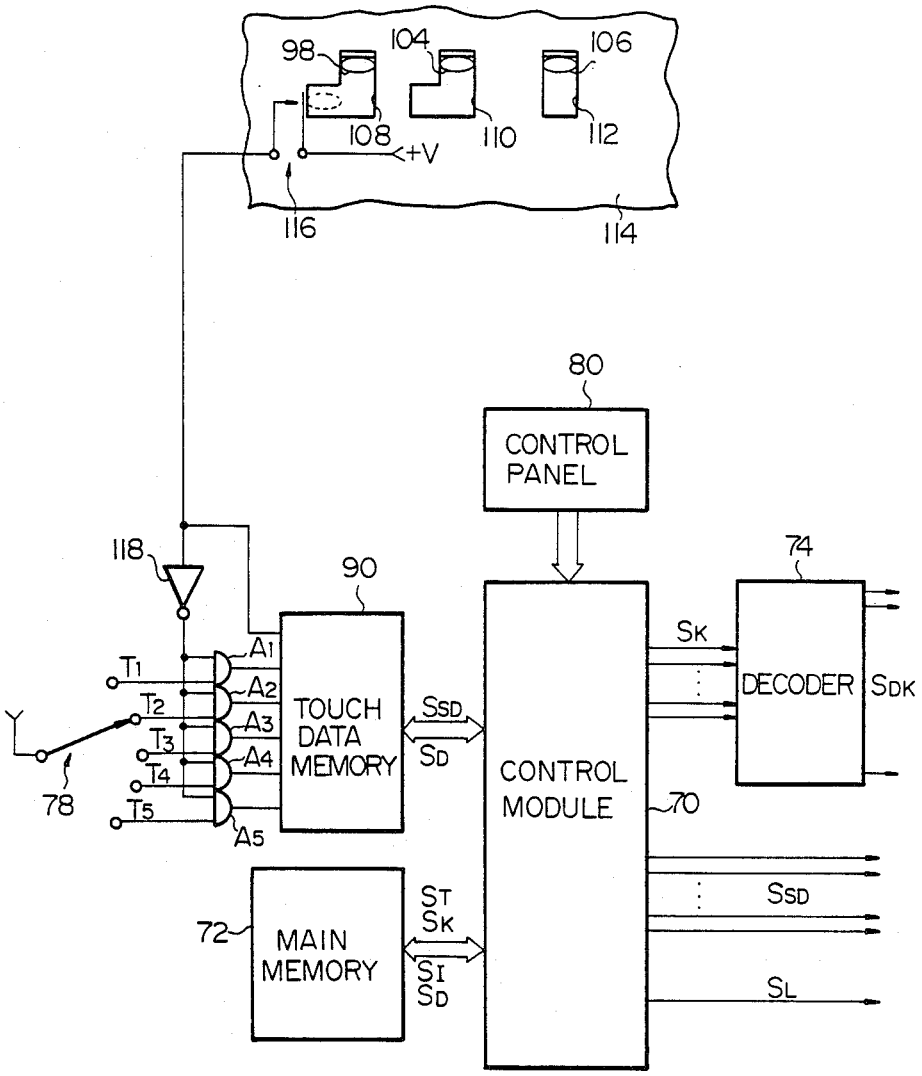
FIG. 7 is a view similar to FIG. 2 but shows the arrangement of the playback control circuit provided in a second preferred embodiment of an automatic player piano according to the present invention.

FIG. 7 shows part of a second preferred embodiment of an automatic player piano according to the present invention. The embodiment herein shown is also generally similar to various respects to the prior-art automatic player piano typically described with reference to FIGS. 1 to 4.

In the automatic player piano shown in FIG. 7, the control circuit has a touch data memory similar to its counterpart in the embodiment of FIG. 6 and also denoted by reference numeral 90. Thus, the touch data memory 90 of the control circuit herein shown has a total of six table sections including the additional dynamic range $R_0$ but such a touch data memory 90 is associated with a dynamic range selector switch similar to its counterpart in the prior-art automatic player piano typically described with reference to FIGS. 1 to 4. The dynamic range selector switch in the embodiment of FIG. 7 is thus also denoted by reference numeral 78 and has the first to fifth states $T_1$ to $T_5$ respectively corresponding to the first to fifth table sections of the touch data memory 90. The dynamic range selector switch 78 herein shown may typically be a mechanically driven five-position switch unit having the first to fifth states $T_1$ to $T_5$ each implemented by a stationary contact. Between such a five-position dynamic range selector switch 78 and the touch data memory 90 having the six table sections is provided a parallel combination of five two-input AND gates $A_1$ to $A_5$. The AND gates $A_1$ to $A_5$ are associated with the first to fifth contacts $T_1$ to $T_5$, respectively, of the switch unit 78 with one input terminal of each AND gate connected to the switch contact with which the particular AND gate is associated.

The player piano forming the second embodiment of the present invention is assumed to be of the three-pedal type including a sustaining pedal 104 located between the left soft pedal 98 and the right damper or loud pedal which is herein designated by reference numeral 106. These three pedals 98, 104 and 106 project forwardly from the frame structure of the piano through openings 108, 110 and 112, respectively, formed in a front bottom panel 114 forming part of the frame structure. Of these three openings 108, 110 and 112, the opening 110 for the sustaining pedal 104 usually has a lower lateral extension so that the pedal 104 can be maintained in a depressed position when sidewise moved into the lateral extension. In the automatic player piano embodying the present invention as herein shown, the opening 108 for the soft pedal 98 also has such a lower lateral extension so that the pedal 98 can be maintained and locked in a depressed position when sidewise moved into the lateral extension as indicated by a broken line.

In association with the soft pedal 98 thus arranged is provided a normally-open soft-pedal responsive switch 116 having one conatct connected to a source of a positive supply voltage +V and the other connected to the sixth table section of the touch data memory 90. The switch 116 is responsive to the movement of the soft pedal 98 into and out of the extension of the pedal opening 108 is closed when the pedal 98 is moved into the extension. The latter contact of the soft-pedal responsive switch 116 is also connected through an inverter 118 to the other input terminal of each of the five AND gates $A_1$ to $A_5$ provided between the dynamic range selector switch unit 78 and the touch data memory 90 as shown. The control circuit thus arranged is also connected to the solenoid-operated key actuator units 18 through a solenoid drive control circuit constructed and arranged similarly to the circuit shown in FIG. 4.

When, now, the soft pedal 98 is held in a normal raised position as indicated by a full line, the soft-pedal responsive switch 116 is maintained open so that a potential of a high level occurs at the output terminal of the inverter 118 and thus maintains all of the AND gates $A_1$ to $A_5$ open. If one of the contacts $T_1$ to $T_5$ of the dynamic range selector switch unit 78 is activated under these conditions, the table section corresponding to the particular switch contact is selected through the associated one of the AND gates $A_1$ to $A_5$. Accordingly, the solenoid-operated key actuator units 18 are selectively energized to generate sound with any one of the dynamic ranges represented by the plots $R_1$ to $R_5$ shown in FIG. 3, as described with reference to FIGS. 2 to 4.

On the other hand, when the soft pedal 98 is moved into the lower lateral extension of the pedal opening 108 as indicated by the broken line, the soft-pedal responsive switch 116 is closed so that a potential of a low level occurs at the output terminal of the inverter 118 and thus maintains all of the AND gates $A_1$ to $A_5$ closed. Under these conditions, none of the first to fifth table sections of the touch data memory could not be selected. The movement of the soft pedal 98 into the lower lateral extension of the opning 108 is follwed by axially upward movement of the hammer rest rail actuator rod 56 (FIG. 1), which therefore causes the hammer rest rail assembly 48 to turn rearwardly through a predetermined angle about the center pin on the hammer bat 38. The hammer rest rail assembly 48 being thus turned, each of the hammer heads 44 of all the hammer assemblies is allowed to have a position closer to the piano string 20 as indicated by phantom lines in FIG. 1B.

The soft-pedal responsive switch 116 being closed, furthermore, the positive supplyvoltage +V is applied to select the sixth table section of the touch data memory 90 so that the solenoid-operated key actuator units 18 are selectively energized with currents controlled in such a manner as to provide the dynamic range represented by the plot $R_0$ shown in FIG. 5. In this instance, the hammer heads 44 are enabled to strike against the strings 20 effectively and at proper timings for the reason explained with respect to the embodiment of FIG. 6.

While each of the preferred embodiments described of an automatic player piano according to the present invention is of the upright type, the subject matter of the present invention is apparently applicable with ease to an automatic playe piano of the grand type. When the present invention is to be thus applied to a grand piano, the shift pedal of the piano may be acted upon similarly to the soft pedal in the first described embodiment or may be locked similarly to the soft pedal in the second described embodiment.

If desired, furthermore, the additional sixth table section provided in the touch data memory 90 in each of the embodiments described may be replaced with a modified version of one of the first to fifth table sections, preferably the first table section, of the touch data memory 76. Such a modified version of the first table section or any other table section of the touch data memory 76 may be generated by arithmetic operation such as subtraction reducing a predetermined value from the values memorized in the particular table section, instead of memorizing the values of the sixth table per se.

What is claimed is:

1. An automatic play piano including a plurality of keyboard keys and having a first mode of playback operation producing sounds with sound intensity level ina range selected from predetermined operable ranges inherent in the player piano and a second mode of playback operation producing sounds with sound intensity levels within a predetermined lowerst range at least partially lower than any of said predetermined operable ranges, comprising:

(a) selector means for selecting one of said first and second modes of opeation, (b) sound level reducing means for reducing the sound intensity levels of the sounds to be produced by the player piano and being actuated in response to selection of said second mode of operation, (c) data means producing intensity information representative of a plurality of different sound intensity ranges each defining a predetermined number of different sound intensity levels, and (d) key driver means operative to actuate selected ones of said keyboard keys on the basis of the information representative of said different sound intensity ranges produced by said data means except for the lowest one of the different sound intensity ranges when said first mode of operation is selected by said selector means and on the basis of the information representative of said lowest one of said different sound intensity ranges when said second mode of operation is selected by said selector means.

2. An automatic player piano comprising:

(a) a plurality of keyboard keys;

(b) a plurality of piano strings respectively associated with said keyboard keys;

(c) an action mechanism intervening in effect between said plurality of keyboard keys and said plurality of pinao strings, said action mechanism including string striking members respectively associated with said keyboard keys and with said piano strings, each of the string stiking members being responsive to the movement of the associated one of the keyboard keys and operative to strike against the associated one of the piano strings, and sound level reducing means for reducing the intensity levels of sounds to be produced by said string striking members, said sound level reducing means being movable from an inoperative first position to an operative second position;

(d) a plurality of separate key actuating means respectively associated with said keyboard keys and each operative to actuating the associated one of the keyboard keys when activated;

(e) activating means for activating each of said key actuating means;

(f) memory means storing musical information representative of music which may be played back by said player piano, said musical information including pieces of sound intensity level information;

(g) data storage means for producing sound intensity information representative of a plurality of different sound intensity ranges each having a predetermined number of different sound intensity levels respectively corresponding to the pieces of sound intensity level information stored insaid memory means, said activating means being responsive to the information supplied from said memory means and said data storage means for activating each of said key actuating means at each of the intensity levels represented by said sound intensity information;

(h) selector means for selecting one of said sound intensity ranges produced by said data storage means; and (i) drive means for moving said sound level reducing means from said first position to said second position when the lowest one of said plurality of sound intensity ranges is selected.

3. An automatic player piano as set forth in claim 2, in which said drive means comprises signal generating means for producing a driver signal when said lowest one of said plurality of sound intensity ranges is selected in said selector means and an actuator unit responsive to said driver signal for moving said sound level reducing means from said first position to said second position.

4. An automatic player piano as set forth in claim 3, further comprising a foot-operated member engageable with said sound level reducing means through an actuator rod which forms part of said drive means, said actuator unit being held in engagement with said actuator rod and driving the actuator rod into driving engagement with said sound level reducing means for moving the sound level reducing means from said first position to said second position in response to said driver signal produced by said signal generating means.

5. An automatic player piano as set forth in claim 2, in which said drive means comprises a foot-operated member engageable with said sound level reducing means through an actuator rod and locking means for allowing said foot-operated member to remain in a depressed position maintaining said sound level reducing means in said second position thereof through said actuator rod, said selector means comprising a sound intensity range selector switch operative to select one of said sound intensity ranges except for said lowest one of the sound intensity ranges and logic switch means operative to select said lowest one of the sound intensity ranges.

6. An automatic play piano as set forth in claim 5, in which said logic switch means comprises a plurality of logic gate circuits associated repsectively with said sound intensity ranges except for said lowest one of the sound intensity ranges and having respective first input terminals to be selectively activated by said sound intensity range selector switch and respective second input terminals, and a switch responsive to the movement of said foot-operated member into and out of said depressed position and operative to select said lowest one of said sound intensity ranges.

* * * * *